US009049944B2

(12) United States Patent
Chen

(10) Patent No.: US 9,049,944 B2
(45) Date of Patent: Jun. 9, 2015

(54) SOLID GEL CUSHION SYSTEM

(71) Applicant: Forsound Corp., Kaohsiung (TW)

(72) Inventor: Fu-Chieng Chen, Kaohsiung (TW)

(73) Assignee: FORSOUND CORP., KAOHSIUNG (TW)

( * ) Notice: Subject to any disclaimer, the term of this patent is extended or adjusted under 35 U.S.C. 154(b) by 0 days.

(21) Appl. No.: 14/202,540

(22) Filed: Mar. 10, 2014

(65) Prior Publication Data

US 2015/0074913 A1 Mar. 19, 2015

(30) Foreign Application Priority Data

Sep. 18, 2013 (TW) ..... 102133889 A

(51) Int. Cl.
*A47C 3/16* (2006.01)
*A47C 27/08* (2006.01)

(52) U.S. Cl.
CPC ..... *A47C 27/085* (2013.01)

(58) Field of Classification Search
CPC ..... A47C 7/021; A47C 3/16; A47C 27/085; A47C 27/142; A47C 27/144; A47C 27/146; A47C 27/053; A47C 7/022; A47B 91/00
USPC ..... 5/652, 653, 644, 909, 655.5
See application file for complete search history.

(56) References Cited

U.S. PATENT DOCUMENTS 2,800,688 A * 7/1957 Lobel ..... 52/663
4,713,854 A * 12/1987 Graebe ..... 5/652
5,153,956 A * 10/1992 Nold ..... 428/218
5,788,332 A * 8/1998 Hettinga ..... 297/452.55
6,161,238 A * 12/2000 Graebe ..... 5/648
6,413,458 B1 7/2002 Pearce
6,446,289 B1 * 9/2002 Su et al. ..... 5/709
6,489,000 B1 * 12/2002 Ogura et al. ..... 428/45
6,625,830 B2 * 9/2003 Lampel ..... 5/653
6,898,814 B2 5/2005 Kawamura et al.
6,938,290 B2 * 9/2005 McKinney et al. ..... 5/654
7,794,022 B2 * 9/2010 Caruso et al. ..... 297/452.56
8,062,456 B2 * 11/2011 Kuo ..... 156/247
8,087,726 B2 * 1/2012 Chen ..... 297/284.5
8,424,137 B1 4/2013 Pearce
8,434,748 B1 * 5/2013 Pearce et al. ..... 267/142
1,333,019 A1 6/2013 Chen
2003/0037377 A1 * 2/2003 Kawamura et al. ..... 5/652

(Continued)

OTHER PUBLICATIONS

Lisa, LisaJan Loves to Quilt, Apr. 22, 2012, Blogspot.com, Scappy Sparks Quilt.*

*Primary Examiner* — Robert G Santos
*Assistant Examiner* — Ifeolu Adeboyejo
(74) *Attorney, Agent, or Firm* — WPAT, P.C.; Anthony King; Kay Yang

(57) ABSTRACT

A solid gel cushion system is provided. The solid gel cushion system includes a first elastic quadrilateral body having a first elastic surrounding sidewall to define a first space allowing for a heat exchange. The first elastic quadrilateral body defines a first top surface and a first bottom surface with respect to the first elastic surrounding sidewall, both of which are communicative of surrounding atmosphere in order to form an air passage. The cushion system further includes a second elastic quadrilateral body having a second elastic surrounding sidewall defining a second space in which two interleaving elastic supporting ribs are formed. The first elastic quadrilateral body is surrounded by the four second elastic quadrilateral bodies.

9 Claims, 6 Drawing Sheets

(56) References Cited

U.S. PATENT DOCUMENTS

2006/0138297 A1* 6/2006 Esimai ..... 248/346.01
2008/0016622 A1* 1/2008 Prust ..... 5/653
2010/0005594 A1* 1/2010 Rancourt et al. ..... 5/652
2011/0094037 A1* 4/2011 Chen ..... 5/655.5
2013/0167302 A1 7/2013 Pearce

* cited by examiner

SOLID GEL CUSHION SYSTEM

BACKGROUND

1. Technical Field

The present disclosure relates to a solid gel cushion system, in particular, to a solid gel cushion system capable of redistributing the pressure on the area where such pressure is applied, in order to provide a better user experience with superior supportiveness in addition to facilitating the hot air and cold air exchange transferring the heat out of the disclosed cushion system.

2. Description of Related Art

Please refer to U.S. application Ser. No. 13/330,192 titled "PAD STRUCTURE FOR ABSORBING VIBRATION AND DISPERSING PRESSURE" (hereinafter "'192 application") filed on Dec. 29, 2011 along with the current application are applied by the same inventor. The structure in '192 application includes a pressure absorbing layer, a positioning column, and a buffer layer. The shock-absorbing layer includes one isolated surface and a plurality of coupling holes with one side of the coupling holes communicative of surrounding atmosphere and the other side thereof isolated from the surrounding atmosphere. Since at least one side of the shock-absorbing layer is isolated from the atmosphere, certain support may be provided. However, also because of the surface not communicative of the atmosphere the cold air/hot air exchange may not take place, failing to offer quality user experience when the heat associated with the use of the structure in '192 application may not be transferred out of the structure in a timely manner.

In addition, even the structures disclosed in U.S. Pat. Nos. 6,413,458, 8,424,137 and 6,898,814 and US patent publication 2013/0167302 employ the gel as the material for the manufacturing of the structure they fail to achieve the goals of better supportiveness/user experience and the proper heat exchange at the same time.

Therefore, in order to remedy the deficiency in the above-mentioned background arts, the present application provides a solid gel cushion system capable of offering the better supportiveness/user experience and facilitating the better heat exchange at the same time.

SUMMARY OF THE DISCLOSURE

The present disclosure is to provide a solid gel cushion system, can solve the problems of the deficient supportiveness and inferior heat dissipation in the traditional arts.

The cushion system in present disclosure includes four elastic quadrilateral bodies each has a bottom surface and interleaving supporting ribs (second elastic quadrilateral bodies) enclosing a hollow first elastic quadrilateral body. When a top surface of the second elastic quadrilateral body is isolated from surrounding atmosphere because of the application of the pressure, the space inside the second elastic quadrilateral body may be squeezed to compress the air therein and therefore to increase the pressure and inflate the second elastic quadrilateral body, so as to provide the better supportiveness. Along with the elastic supporting ribs, such cushion system may be capable of offering the better user experience. Since a surrounding sidewall of the second elastic quadrilateral body may expand toward an inner space of the first elastic quadrilateral body because of the inflated inner space thereof, the inner space of the first elastic quadrilateral body may be downsized and therefore the heat may be transferred out of the cushion system to facilitate the heat exchange. When the pressure is no longer applied to the second elastic quadrilateral body, the surrounding sidewall of the second elastic quadrilateral body may be restored to its original position and the inner space of the first elastic quadrilateral body may be caused to restore to its original size. As such, the cushion system of the present disclosure may function as a pump to properly transfer the heat out of the system. Plus, when a number of first elastic quadrilateral bodies are utilized the second elastic quadrilateral bodies in four times of that number may become necessary for a large-size cushion system to be prepared. As the first elastic quadrilateral body is hollow in its design, the entire weight of the cushion system may be effectively reduced and therefore could be carried around without too much difficulty.

The present disclosure can be applied for the user to sit on, to lean to, and to sleep on, for the neck to be positioned, and even serve as a part of a pillow.

The solid gel cushion system may include a first elastic quadrilateral body having a first elastic surrounding sidewall to define a first space allowing for a heat exchange, the first elastic quadrilateral body defining a first top surface and a first bottom surface with respect to the first elastic surrounding sidewall, both of which are communicative of surrounding atmosphere in order to form an air passage, the first elastic surrounding sidewall connecting to a second elastic quadrilateral body having a second elastic surrounding sidewall defining a second space in which two interleaving elastic supporting ribs are formed, two terminals of the elastic supporting ribs connected to the second elastic surrounding sidewall of the second elastic body for separating the second space into a plurality of sub-spaces, the second elastic body defining a second top surface and a second bottom surface, wherein the second top surface is communicative of the surrounding atmosphere with the second bottom surface isolated from the surrounding atmosphere so that the first elastic quadrilateral body is surrounded by the four second elastic quadrilateral bodies.

The solid gel cushion system may adopt an impact absorption polymer with superior heat conductivity. Such polymer may be implemented in terms of a co-polymer that is thermoformable, such as SEBS (hydrogenated styrene-butadiene copolymer) to form a flexible and elastic gel. Also, the hardness level of the gel can be adjusted as needed, and with low rebound resilience it is particularly suitable for the production of high flexibility mat body.

More specifically, the first elastic quadrilateral body and a second elastic quadrilateral system share the same surrounding sidewall.

More specifically, the first elastic surrounding sidewall of the first elastic quadrilateral body and the second elastic surrounding sidewall may be substantially the same in length.

More specifically, the interleaving supporting ribs and the second elastic surrounding sidewall may be substantially the same in height.

More specifically, the interleaving elastic supporting ribs may be standing X-shaped or in the form of a standing cross.

More specifically, the first elastic surrounding sidewall and the second elastic surrounding sidewall may be 1-5 centimeters in length.

More specifically, the first elastic surrounding sidewall and the second elastic surrounding sidewall may be 1-5 centimeter in height.

More specifically, the first elastic sidewall and the second elastic sidewall are 2-10 centimeters in thickness.

More specifically, the solid gel cushion system according to one embodiment of the present disclosure may include multiple first elastic quadrilateral bodies, each of which may be surrounded by four second elastic quadrilateral bodies, to form a large-sized cushion.

For further understanding of the present disclosure, reference is made to the following detailed description illustrating the embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DESCRIPTION OF THE EXEMPLARY EMBODIMENTS

Figure 1:
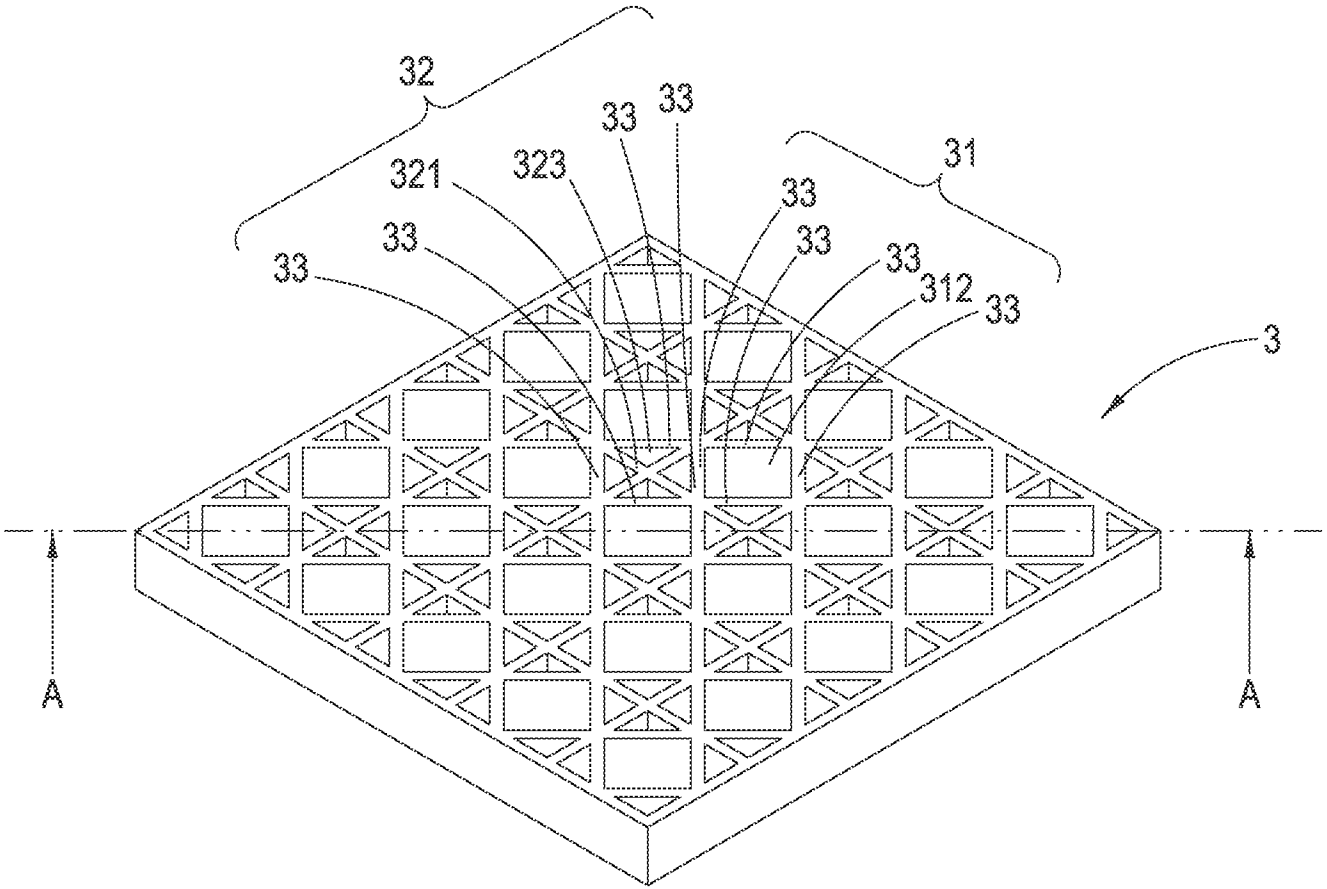
FIG. 1 shows a schematic diagram of a solid gel cushion system according to one embodiment of the present disclosure.

The aforementioned and other technical contents, features, and efficacies will be shown in the following detail descriptions of a preferred embodiment corresponding with the reference Figures.

Please refer to FIGS. 1, 2, 3A and 3B, which are a schematic diagram, a top view, a cross sectional view, and a front view of a cross section of a solid gel cushion system 3 according to one embodiment of the present disclosure. The solid gel cushion system 3 may include a first elastic quadrilateral body 31, which may further include a first the first surrounding elastic sidewall 33 defining a first space 313 for the heat exchange with the surrounding atmosphere. In one implementation, the first surrounding elastic sidewall 33 may be 1-5 centimeters in its length and height. The first elastic quadrilateral body 31 may define a first bottom surface 311 and a first top surface 312 with respect to the first surrounding elastic sidewall 33. As shown in the above figures, the first bottom surface and the first surrounding elastic sidewall 33 of the first elastic quadrilateral body 31 may be connected to one second elastic quadrilateral body 32. Such second elastic quadrilateral body 32 may also have a second surrounding elastic sidewall 33. In one implementation, the second surrounding elastic sidewall 33 may be 1-5 centimeters in height and length, also defining a second space. It is worth noting the first surrounding elastic sidewall and the second surrounding elastic sidewall may be monolithically formed. Thus, the first surrounding elastic sidewall and the second surrounding elastic sidewall share the same reference number here. The second space may have two diagonally interleaving elastic support ribs 321 formed therein.

In one implementation, the interleaving support ribs 321 together may be standing X-shaped or shaped or in terms of a standing cross. Two terminals of each of the two interleaving supporting ribs 321 may be connected to the junctions of the sidewalls of the second surrounding elastic sidewall 33. In other words, the four corners of the second surrounding elastic sidewall 33 may be connected to the terminals of the two interleaving supporting ribs 321. Accordingly, the second space may be divided into four sub-spaces 324, and the second elastic quadrilateral body 32 may also define a second bottom surface 322 and a second top surface 323 with respect to the second surrounding sidewall 33. As illustrated in the above-mentioned Figures, the bottom surface 322 may not be communicative of the surrounding atmosphere while the second top surface 323 may be adapted to be communicative of the surrounding atmosphere.

The first elastic quadrilateral body member 31 and the second elastic quadrilateral body 32 may be rectangle or square-shaped or in form of a rhombus by using orthography projection. In this embodiment, both the first elastic quadrilateral body 31 and the second elastic quadrilateral body 32 are in the form of a rhombus capable of providing the robust supporting performance when in conjunction with the diagonally interleaving elastic supporting ribs.

Figure 2:
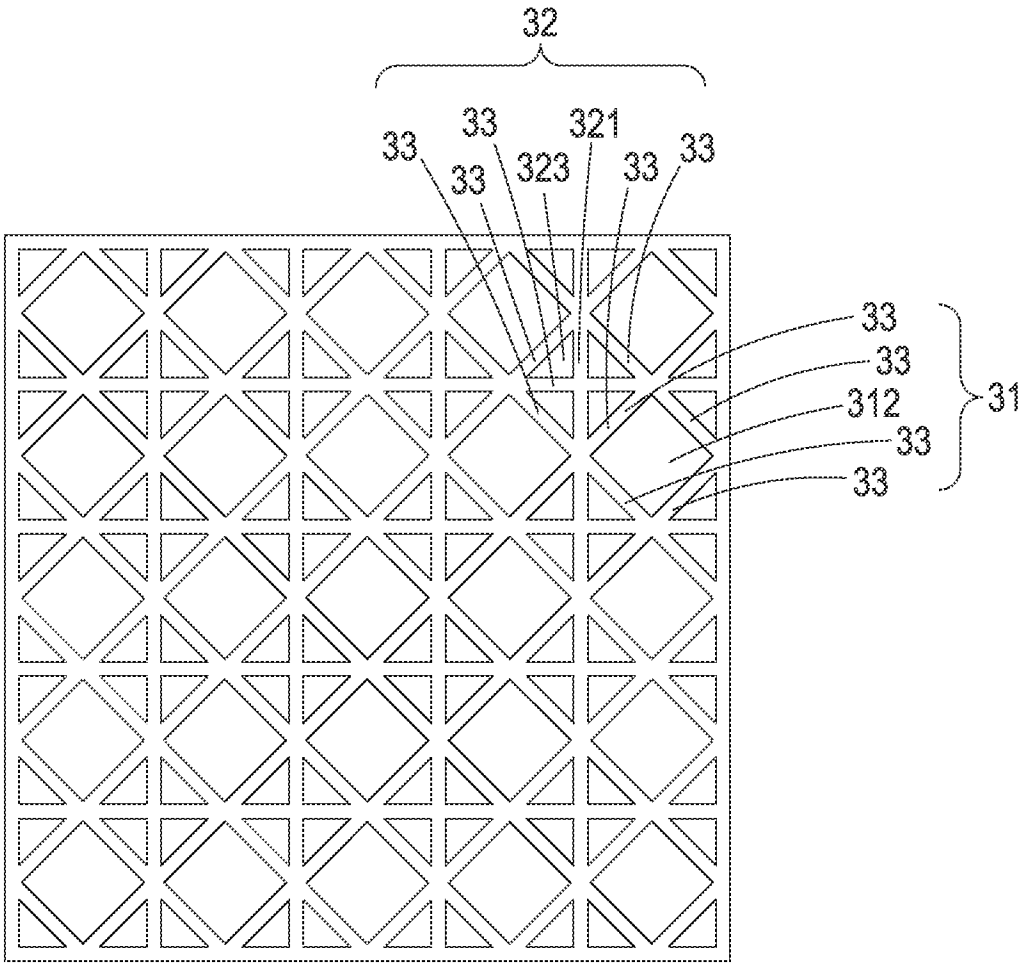
FIG. 2 shows a top view of a solid gel cushion system according to one embodiment of the present disclosure.
Figure 3A:
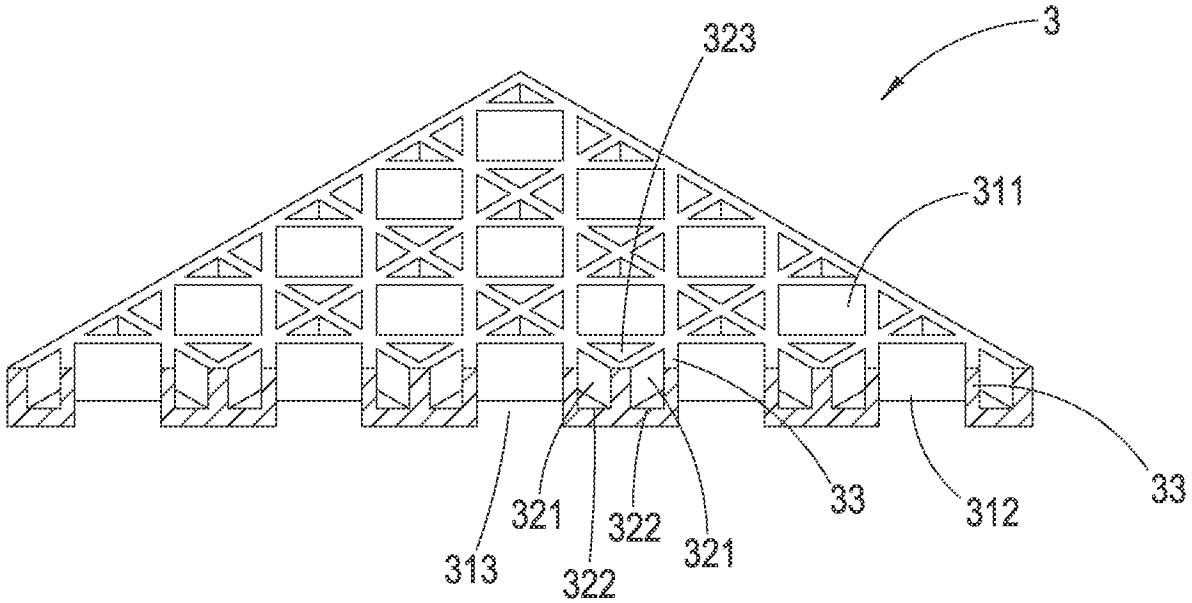
FIG. 3A shows a cross-sectional view of a solid gel cushion system along A-A according to one embodiment of the present disclosure.
Figure 3B:
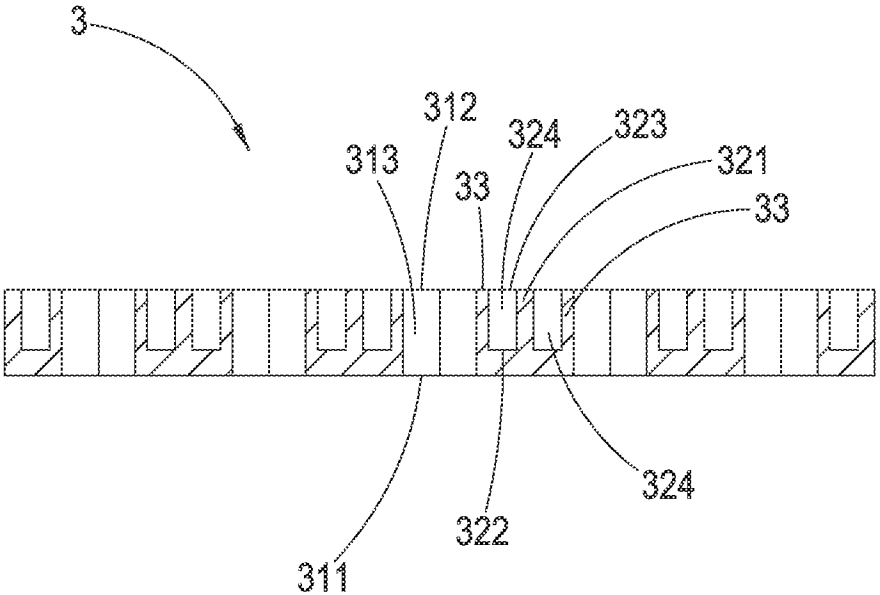
FIG. 3B shows a front view of the cross section along A-A according to one embodiment of the present disclosure.

As shown in both FIG. 2 and FIG. 3A, the first elastic quadrilateral body 31 may be surrounded by four second elastic quadrilateral bodies 32. Since the first elastic quadrilateral body and the second elastic quadrilateral body 32 may share the surrounding elastic sidewall (e.g., the first surrounding elastic sidewall or the second surrounding elastic sidewall). Therefore, the first elastic surrounding sidewall 33 of the first elastic quadrilateral body 31 and the second elastic surrounding sidewall 33 of the second elastic quadrilateral body 32 may be substantially the same in length, while the elastic supporting ribs and the second surrounding elastic sidewall 33 of the second elastic quadrilateral body 32 may be substantially the same in height.

Figure 4A:
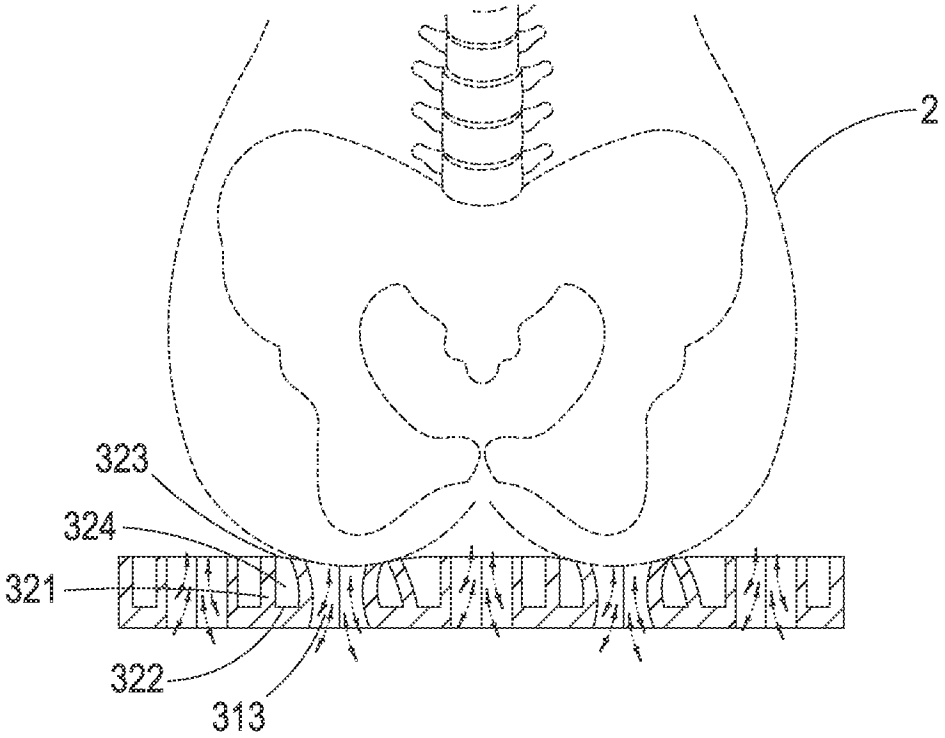
FIG. 4A shows a schematic diagram of an implementation of a solid gel cushion system according to one embodiment of the present disclosure.

As shown in FIGS. 1 and 4A, the solid gel cushion system 3 may include multiple first elastic quadrilateral bodies 31, and each of the first elastic quadrilateral bodies 31 may be surrounded by the four second elastic quadrilateral bodies 32. With multiple first elastic quadrilateral bodies 31 and the second elastic quadrilateral bodies 32 arranged in the above manner, a large-sized cushion may be prepared. The second elastic quadrilateral body 32 may be regarded as being surrounded by four first elastic quadrilateral bodies 31. Plus, the positional arrangement of the second elastic quadrilateral bodies 32 and the connection of the terminals of the elastic supporting ribs to the corners of the second elastic surrounding sidewall may enable the elastic supporting ribs 321 in one second elastic quadrilateral body 32 indirectly connect to the elastic supporting ribs in the neighboring second elastic quadrilateral bodies 32. Consequently, when the user body 2 exerts the pressure on the solid gel cushion system 3, such pressure may be shared among the surrounding elastic sidewall 33 and the elastic supporting ribs 321 with its horizontal, vertical and oblique components. Further, since the elastic surrounding sidewalls 33 and the elastic supporting ribs 321 are connected to each other, the exerted pressure could be allocated in the form of its horizontal component, vertical component (through the elastic sidewalls 33), and two oblique components (through the elastic supporting ribs 321). Thus, the exerted unidirectional pressure from the user body 2 may be properly redistributed in its components in other directions, rendering possible the proper vibration absorbance and impact dispersion. Since the exerted pressure is properly redistributed the user experience of the cushion system may significantly improve as the cushion system is superior in its compressibility, softness, and supportiveness.

Specifically, as shown in FIG. 4A, when the user body 2 exerts the pressure on the solid gel cushion system 3, the first top surfaces and the second top surfaces of certain first elastic quadrilateral bodies 31 and the second elastic quadrilateral bodies 32 where the pressure is applied may be isolated from the surrounding atmosphere, compressing the air inside the second elastic quadrilateral bodies 32. Since the second spaces within the second elastic quadrilateral bodies have been separated into several sub-spaces, accelerating the rate of the compression of the air inside the second spaces, increasing the internal pressure of the second elastic quadrilateral bodies 32, and expanding the size of second elastic quadrilateral bodies 32. As such, the second surrounding elastic sidewall 33 of the second elastic quadrilateral body 33 may extend toward the inner space of the first elastic quadrilateral body 31, which may convert the sub-spaces between the second elastic surrounding sidewall 33 and the elastic supporting ribs 321 to small balloons to be supportive of the user body 2 with the elastic supporting ribs 321 being collaborated and therefore serve as the buffer for the user body 2 and prevent the same from being against the subject on which the cushion system 3 is placed. Also because of the second surrounding elastic sidewall 33 of the second elastic quadrilateral body 32 extending toward the inner space of the first elastic quadrilateral body 31 the inner space 313 of the first elastic quadrilateral body 31 may be minimized and therefore the air inside the inner space 313 may be pushed out for achieving the goal of the heat dissipation.

Figure 4B:
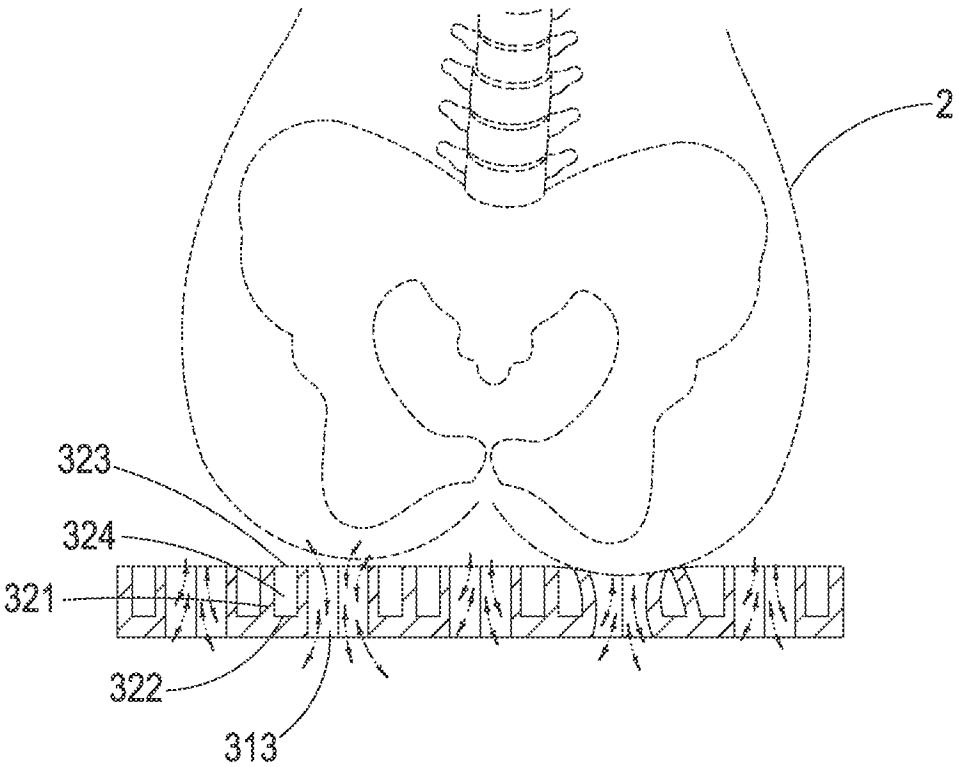
FIG. 4B shows another schematic diagram of an implementation of a solid gel cushion system according to one embodiment of the present disclosure.

Thereafter, as shown in FIG. 4B, when user body 2 repositions or moves away from certain second top surfaces 323 of the second elastic quadrilateral bodies 32 second surrounding sidewalls of those second top surfaces 323 to which the pressure of the user body 2 is no longer applied may revert back to where they are originally, gradually increasing the inner space 313 inside the first elastic quadrilateral body 31 and thus causing the cold air in the surrounding atmosphere to enter into the inner space 313. In short, the move of user body 2 could inflate or deflate the elastic surrounding sidewall of the second elastic quadrilateral body 32, which may therefore function as a pump continuously sucking in or discharging out the air inside the space of the first elastic quadrilateral body 31 via the hollow air passage to realize the heat exchange. Consequently, in addition to enjoying the sufficient amount of the support the user body 2 may also be comforted with the coolness and the freshness.

The above-mentioned gel is associated with excellent capability of transferring the pressure and absorbing the impact, which may be a polymer compound or a co-polymer. The solid gel may be thermally formable such as SEBS (hydrogenated styrene and butadiene copolymer. Such solid gel could be heated to be melted and then cooled into a flexible elastomeric structure. The solid gel can also be the two components PU system gel elastomer, which is formed by "A component" acts as PU prepolymer and "B component" acts as polyol, mixed both components by a designed ratio for specific hardness, Plus, the hardness of the solid gel maybe adjusted because of the different combinations of the composing materials and such solid gel therefore could be with the reduced bouncing flexibility and capable of diverting the applied pressure. Accordingly, the solid gel according to the present disclosure may be particularly suitable for the production of the tendered cushion body.

The present disclosure provides a solid gel cushion system, and when compared with other conventional arts has the following advantages:

(1) the exerted pressure can be spread out along the different directions to improve the user experience and allows for the user to enjoy the sufficient amount of support; plus, the heat exchange between the cushion system and the surrounding atmosphere may be realized as the heat could be discharged out of the cushion system via the hollow air passage of the first elastic quadrilateral body to enable the heat dissipation;

(2) the present disclosure may effectively resolve the problem of the traditional cushion systems of being carried around with difficulty and improve the problem of the lack of support provided in the traditional counterparts (3) because the gel is better at absorbing and transferring the heat and the second elastic surrounding sidewall is capable of expanding outwardly considering the second elastic quadrilateral body (or the second elastic surrounding sidewall) is connected to the hollow first elastic quadrilateral body, the heat may be discharged out of or the cold air may be sucked into the space of the first elastic quadrilateral body depending on whether the pressure is applied to the second elastic quadrilateral body functioning as a pump for realizing heat exchange and comforting the user utilizing the cushion system; and (4) when the user sits on the top surface of the second elastic quadrilateral body, the top surface may form a virtually air-tight inner space defined between the top surface and the enclosed bottom of the second elastic quadrilateral body, further strengthening the supportiveness and preventing the cushion system from being "bottomed out" (or preventing the user from sitting against the ground); compared with the traditional arts formed in terms of grid-shaped and hollowed units, the cushion system according to present disclosure is better at supporting; and the elastic surrounding sidewalls of the second elastic quadrilateral body when the second elastic quadrilateral body receives the pressure (asserted force) from above may expand toward the first elastic quadrilateral body because of the air-tight inner space, functioning as an air flow pump and therefore facilitating the expedient exchange of the air flow to discharge the air and realize the heat dissipation more efficiently, both of which may not be achieved in the traditional approaches.

Some modifications of these examples, as well as other possibilities will, on reading or having read this description, or having comprehended these examples, will occur to those skilled in the art. Such modifications and variations are comprehended within this disclosure as described here and claimed below. The description above illustrates only a relative few specific embodiments and examples of the present disclosure. The present disclosure, indeed, does include various modifications and variations made to the structures and operations described herein, which still fall within the scope of the present disclosure as defined in the following claims.

What is claimed is:

1. A solid gel cushion system comprising:

a plurality of first elastic quadrilateral bodies, with each first elastic quadrilateral body having:

a first elastic surrounding sidewall to define a first space allowing for heat exchange; and a first top surface and a first bottom surface with respect to the first elastic surrounding sidewall, both of which are communicative of surrounding atmosphere in order to form an air passage extending from the first top surface to the first bottom surface; and a plurality of second elastic quadrilateral bodies, with each second elastic quadrilateral body having:

a second elastic surrounding sidewall defining a second space;

two interleaving elastic supporting ribs formed in the second space, the elastic supporting ribs are crossed to separate the second space into a plurality of sub-spaces;

a second top surface communicative of the surrounding atmosphere, wherein the second top surface and the first top surface are coplanar; and a second bottom surface of the sub-spaces isolated from the surrounding atmosphere, wherein the second bottom surface and the first bottom surface are non-coplanar;

wherein each of the second elastic quadrilateral body is surrounded by four of the first elastic quadrilateral bodies, and each of the first elastic surrounding sidewall of the four first elastic quadrilateral bodies connects to the second elastic surrounding sidewall of the surrounded second elastic quadrilateral body.

2. The solid gel cushion system according to claim 1, wherein the first elastic quadrilateral body and the second elastic quadrilateral body share the first elastic surrounding sidewall and the second elastic surrounding sidewall.

3. The solid gel cushion system according to claim 1, wherein the first elastic surrounding sidewall and the second elastic surrounding sidewall are substantially equal in length.

4. The solid gel cushion system according to claim 1, wherein the elastic supporting ribs and the second elastic sidewall are substantially the same in height.

5. The solid gel cushion system according to claim 1, wherein the interleaving elastic supporting ribs are standing X-shaped or in form of a standing cross.

6. The solid gel cushion system according to claim 1, wherein the first elastic surrounding sidewall and the second elastic surrounding sidewall are 1-5 centimeters in length.

7. The solid gel cushion system according to claim 1, wherein the first elastic sidewall and the second elastic sidewall are 1-5 centimeters in height.

8. The solid gel cushion system according to claim 1, wherein the first elastic quadrilateral body and the second elastic quadrilateral body may be rectangle or square-shaped or in form of a rhombus by using orthography projection.

9. The solid gel cushion system according to claim 1, wherein the first elastic sidewall and the second elastic sidewall are 2-10 centimeters in thickness.

* * * * *